US008430944B2

(12) United States Patent
Iijima

(10) Patent No.: US 8,430,944 B2
(45) Date of Patent: Apr. 30, 2013

(54) FINE PARTICLE RECOVERY METHODS FOR VALVE METAL POWDERS

(75) Inventor: Hitoshi Iijima, Tokyo (JP)

(73) Assignee: Global Advanced Metals, USA, Inc., Waltham, MA (US)

( * ) Notice: Subject to any disclaimer, the term of this patent is extended or adjusted under 35 U.S.C. 154(b) by 635 days.

(21) Appl. No.: 12/622,806

(22) Filed: Nov. 20, 2009

(65) Prior Publication Data

US 2010/0158747 A1 Jun. 24, 2010

Related U.S. Application Data

(60) Provisional application No. 61/139,766, filed on Dec. 22, 2008.

(51) Int. Cl.
*B22F 9/24* (2006.01)

(52) U.S. Cl.
USPC ..... 75/368; 75/369

(58) Field of Classification Search ..... 75/343, 75/363, 368, 622; 148/422; 420/427
See application file for complete search history.

(56) References Cited

U.S. PATENT DOCUMENTS

| | | | | |
|---|---|---|---|---|
| 3,012,877 | A * | 12/1961 | Foos et al. | 75/622 |
| 4,149,876 | A | 4/1979 | Rerat | |
| 4,645,533 | A * | 2/1987 | Izumi | 420/427 |
| 4,684,399 | A | 8/1987 | Bergman et al. | |
| 4,940,490 | A | 7/1990 | Fife et al. | |
| 5,211,741 | A | 5/1993 | Fife | |
| 5,217,526 | A | 6/1993 | Fife | |
| 5,234,491 | A * | 8/1993 | Chang | 75/622 |
| 5,245,514 | A | 9/1993 | Fife et al. | |
| 5,306,462 | A | 4/1994 | Fife | |
| 5,412,533 | A | 5/1995 | Murayama et al. | |
| 5,448,447 | A | 9/1995 | Chang | |
| 5,580,367 | A | 12/1996 | Fife | |
| 6,051,044 | A | 4/2000 | Fife | |
| 6,322,912 | B1 | 11/2001 | Fife | |
| 6,338,816 | B1 | 1/2002 | Fife | |
| 6,375,704 | B1 | 4/2002 | Habecker et al. | |
| 6,420,043 | B1 | 7/2002 | Fife et al. | |
| 6,462,934 | B2 | 10/2002 | Kimmel et al. | |
| 6,527,937 | B2 | 3/2003 | Fife | |
| 6,616,623 | B1 | 9/2003 | Kutushov | |
| 6,699,757 | B1 | 3/2004 | Hwang | |
| 6,788,523 | B1 | 9/2004 | Hossick-Schott et al. | |

(Continued)

FOREIGN PATENT DOCUMENTS

| | | | |
|---|---|---|---|
| CA | 2622336 | A1 | 3/2007 |
| JP | 2006002241 | A1 | 5/2006 |
| WO | 2006062234 | A1 | 6/2006 |
| WO | 2007130483 | A2 | 11/2007 |

*Primary Examiner* — George Wyszomierski
(74) *Attorney, Agent, or Firm* — Kilyk & Bowersox, P.L.L.C.

(57) ABSTRACT

A process and system for producing tantalum or other valve metal particles is provided comprising forming tantalum particles in a reduction process carried out in a reactor vessel, and using a siphon to transfer fine tantalum particles out of the reaction mixture to a recovery vessel. This particle transfer can occur while the reaction mixture is agitated. The tantalum particles can be automatically withdrawn when the reaction mixture has a depth level greater than the fluid level of the tantalum fine particle recovery vessel, and outflow automatically stops when the fluid levels of the reactor and particle recovery vessel equilibrate. Tantalum or other valve metal powders made by the processes, and capacitors made with valve metal powders are also provided.

11 Claims, 1 Drawing Sheet

U.S. PATENT DOCUMENTS 6,804,109 B1 10/2004 Hahn et al.
6,813,140 B1 11/2004 Huntington
6,870,727 B2 3/2005 Edson et al.
7,172,985 B2 2/2007 Pinceloup et al.
7,190,571 B2 3/2007 Heusmann et al.
2004/0205947 A1 * 10/2004 Oda et al. ..... 29/25.03

* cited by examiner

FINE PARTICLE RECOVERY METHODS FOR VALVE METAL POWDERS

This application claims the benefit under 35 U.S.C. §119 (e) of prior U.S. Provisional Patent Application No. 61/139,766, filed Dec. 22, 2008, which is incorporated in its entirety by reference herein.

BACKGROUND OF THE INVENTION

The present invention relates to production and recovery of fine valve metal powders, and, in particular, fine tantalum powders, and products incorporating the powders.

Tantalum anodes, made from tantalum powder, have been a major contributor to the miniaturization of electronic circuits and have made possible the application of such circuits in extreme environments. Capacitors with tantalum anodes typically are manufactured by compressing tantalum powder to form a pellet, sintering the pellet in a furnace to form a porous tantalum body (electrode), and then subjecting the porous body to anodization in a suitable electrolyte to form a continuous dielectric oxide film on the sintered body. Development of powders suitable for making tantalum capacitors has resulted from efforts by both capacitor producers and tantalum processors to delineate the characteristics required for tantalum powder for it to best serve in the production of quality capacitors. Such characteristics include specific surface area, purity, shrinkage, pressability, and the like.

Various techniques have been practiced or disclosed for the production of tantalum powders by a reduction of tantalum that can affect one or more of these tantalum particle characteristics. Typical techniques, such as those briefly outlined in Cabot Corporation's U.S. Pat. No. 5,234,491, are reviewed below.

Tantalum powder has been produced in a chemical method by adding sodium to $K_2TaF_7$, which has been previously dissolved in molten salt. In this method, the $K_2TaF_7$ or other reducible tantalum halide and diluent salts are heated in a reaction vessel to a temperature above the melting point of the salt mixture. Liquid sodium is then added. The bath is held at essentially isothermal conditions, with stirring of the bath effected by an internal agitator. The resulting powder has a wide range of particle sizes. In order for these materials to be acceptable for the manufacture of anodes for electrolytic capacitors, they may require extensive classification to obtain the desired particle size distributions. The capacitive charge that can be obtained from anodes derived from these powders typically is in the intermediate range. A modification of this stirred liquid phase reaction scheme involves the introduction of diluent salts to the stirred reaction bath. The addition of diluents such as NaCl and KCl to the $K_2TaF_7$ allows the use of lower bath temperatures. However, this modified process results in agglomerates of finely divided material, a tendency to pick-up impurities, and production of excessive fines.

In another method, solid diluent salt and $K_2TaF_7$ are mulled with liquid sodium and the mixture is heated to the point of initiating a spontaneous exothermic reaction. This exothermic reaction is not easily controlled and, therefore, the product characteristics include varying particle sizes, broad particle size distributions, and varying electrical characteristics. These materials require classification to remove fine and coarse particles from the finished product prior to their utilization in the manufacture of anodes for electrolytic capacitors.

Potassium fluorotantalate ($K_2TaF_7$) also can be electrolytically reduced to tantalum in a molten bath with diluent chloride and fluoride salts of sodium and potassium. In addition, tantalum powder can be made by exothermic reaction in a closed vessel wherein the $K_2TaF_7$ is arranged in alternate layers with reducing agent.

U.S. Pat. No. 4,149,876 discloses techniques for controlling particle size of tantalum powder product in a reduction process wherein molten sodium is added to a molten bath of $K_2TaF_7$ and a diluent salt wherein the sodium addition is controlled during a nucleation period. This patent defines the period of the overall reaction during which the temperature of the charge increases from the initial bath temperature to the reduction temperature as the "nucleation period." When it was desired to produce very fine particle size tantalum powder to be used in the manufacture of anodes employed in the manufacture of high capacitive charge electrolytic capacitors, the sodium metal is disclosed as being added at a very high rate until the reduction temperature is reached. It was also reported in this patent that the rate of sodium injection (feed rate into the reactor) during the nucleation period has an inverse effect on the particle size of the finished product. More specifically, the patent also teaches that the average size of the finished product was inversely related to the rate of temperature rise with respect to time during the nucleation period, and to the time to complete the addition of the required stoichoimetric amount of sodium at that specified reduction temperature, called the "growth period".

U.S. Pat. No. 4,684,399 discloses a process for producing tantalum powder wherein a tantalum compound is added in a continuous or incremental manner to a reactor during the course of the reaction with a reducing metal. The rate of continuous addition or the amount of each increment can be varied depending on the particular tantalum powder product characteristics desired. Continuous addition or the addition of smaller increments tends to favor increased capacitance. The addition of the reducing agent as a single unitary charge prior to the introduction of the tantalum compound, or alternatively, in a continuous or semi-continuous manner is also disclosed.

Canadian published patent application No. 2,622,336 discloses a method for producing a valve metal comprising the step of melting, in a first vessel, a mixture including a valve metal precursor and a diluent, and transferring the mixture to a second vessel in order to mix it under the same or different conditions of temperature and residence time, during which the reaction of the valve metal precursor to form a valve metal is initiated. The ratio of diluting salt to valve metal precursor is generally greater than 1:5 and mostly greater than 1:20. The fineness of a particle is based on reaction temperature, a reducing agent ratio, and the rate of molten salt dilution.

WO 2007/130483 A2 discloses a method of forming fine tantalum particles by dispersedly adding at least one reducing agent into potassium tantalum fluoride dissolved in molten salt, and reducing surface roughness and/or increasing neck thickness of the fine tantalum particles by subjecting the fine tantalum particles to an electrolytic and electrodeposition treatment. The reaction for forming the tantalum particles comprises use of a very high rate of dilution after dissolving $K_2TaF_7$ in potassium chloride, while carrying out incremental addition of sodium and nitrogen addition. Fine particles are collected, without carrying out continuous additions.

Japanese unexamined patent application publication No. 2006-002241 discloses in a first embodiment a process and manufacturing installation for manufacturing a valve metal by reduction of $K_2TaF_7$ with addition of sodium in a diluent containing potassium fluoride and potassium chloride, wherein metallic tantalum and then some diluents are removed from the reactor with a valved exhaust pipe at the bottom of the reactor. The remaining diluent in the reactor is replenished with potassium chloride and potassium fluoride to replace the removed diluent amounts, and is reused. In a second disclosed embodiment, after the reaction step, some upper diluents are removed with an exhaust pipe for disposal and the remainder of diluent is fed to another reactor for reuse, and the metallic tantalum is collected by opening the reactor after cooling. The diluent remainder is replenished with potassium chloride and potassium fluoride to replace the removed diluent amounts, and is reused.

Japanese unexamined patent application publication No. 2006-546787 discloses a method for making tantalum with introduction of heated nitrogen gas into tantalum fluoridation potassium and potassium chloride in a reactor with dilution made to about 15 to 25 times, and incremental sodium is added about 40-60 times after the $K_2TaF_7$ dissolution.

The present inventors have realized that it would be advantageous to provide a reaction system that allows for the production and isolation of fine tantalum particles or other valve metal particles from the reaction system in a more efficient and improved manner.

SUMMARY OF THE PRESENT INVENTION

A feature of the present invention is to provide tantalum powders of small primary particle size.

An additional feature of the present invention is the recovery of fine tantalum particles or other valve metal particles from a molten salt reaction mixture of a reduction process before they coarsen or agglomerate.

Another feature of the present invention is to automatically recover fine tantalum particles or other valve metal particles in a non-disruptive manner from a molten salt reaction mixture concurrent optionally with agitation of the reaction mixture.

An additional feature of the present invention is to recover fine tantalum particles or other valve metal particles from a molten salt reaction mixture in a manner that reduces the amount of exposure of generated tantalum particles to reaction heat and reduces impurities in the particles.

Another feature of the present invention is to provide a process for producing and recovering fine tantalum particles or other valve metal particles in a molten salt reaction mixture at an economical high rate of molten salt dilution.

An additional feature of the present invention is to provide tantalum powders of small primary particle size having high capacitance capability, which are well suited for making high capacitance capacitors and other products.

Additional features and advantages of the present invention will be set forth in part in the description that follows, and in part will be apparent from the description, or may be learned by practice of the present invention. The objectives and other advantages of the present invention will be realized and attained by means of the elements and combinations particularly pointed out in the description and appended claims.

To achieve these and other advantages, and in accordance with the purposes of the present invention, as embodied and broadly described herein, the present invention relates to a process for producing and recovering fine tantalum particles, or other valve metal particles, comprising forming tantalum particles by adding at least one reducing agent into a reaction mixture comprising a reducible tantalum halide and molten diluent salt in a vessel to form fine tantalum particles. An automatic siphon is used to separate the fine tantalum particles from the reaction mixture. With the siphon, fine metal particles are removed from the reaction bath with a small amount of the reaction fluid in which the particles are dispersed. The flowable molten salt materials containing the dispersed final metal particles thus can be isolated from the reaction mixture in a non-disruptive manner by using the siphon arrangement.

The reaction mixture can be agitated when fine tantalum particles, such as primary particles, are separated from the molten reaction mixture with a siphon. The molten reaction mixture is in the form of a flowable fluid material that is responsive to hydrostatic pressures within the process system. The inlet end of the siphon can be positioned at a depth within the reaction mixture wherein the tantalum particles develop to a primary particle of a desired size, such as a small primary particle size. The tantalum particles having a small primary particle size can be transferred out of the reaction mixture from that location before they agglomerate or become coarser. The recovered tantalum particles collected in this manner can be predominantly primary particles. The recovered tantalum particles can predominantly have a particle size less than 2,000 nm, or from about 1 nm to about 2,000 nm, or from about 10 nm to about 1,000 nm, or from about 10 nm to about 100 nm.

In an embodiment, a reduction process for producing tantalum powder is provided where a molten reaction mixture comprising a reducible tantalum halide, a reducing agent and diluent salt is agitated, such as to reduce inter-particle contacts and agglomeration, and fine tantalum particles are automatically withdrawn during the agitation by siphon to a separate recovery vessel when the reaction mixture has a surface level in the reactor vessel that is higher than the surface level of recovered particle fluid in the recovery vessel. Outflow from the reactor vessel will automatically discontinue at and during those times when the reaction mixture fluid level becomes the same as the fluid level in the recovery vessel.

Agitation or other reaction conditions can cause the surface level of the reaction mixture to exceed the surface level of the recovered fluid and particles siphoned into the recovery vessel. The fine particle recovery process and system can further comprise positioning the recovery vessel within an overflow collector container. In this arrangement, the outflow of fluid from the reactor vessel to the recovery vessel, when the fluid surface level in the reactor vessel exceeds the fluid level in the recovery vessel, continues until the fluid level of the recovery vessel reaches an upper open end thereof and overflows into the collector container, and it will continue to overflow as any additional particle fluid is transferred into the recovery vessel via the siphon. The fluid level of the reaction mixture in the reactor vessel then falls to the level of the upper open end of the recovery vessel. At that point, hydrostatic pressure within the system can equilibrate, and outflow of fine particles from the reactor vessel to the recovery vessel via the siphon automatically discontinues. This stoppage of outflow continues unless and until the fluid surface level in the reactor vessel again exceeds that of the recovery vessel, and then the automatic siphon process can repeat itself any number of times without need of operator intervention. This process arrangement also allows for fine tantalum particles having a desired size, such as primary particles, to be conveniently extracted in selectable zones in the reaction mixture where they may concentrate. It also permits withdrawal of the particles without interfering with the agitator, which can be permitted to continue to stir and agitate the reaction mixture and maintain a good dispersion of the reaction mixture and products during particle recovery.

The process of the present invention can provide many advantages and benefits. Fine tantalum particles can be separated and isolated from the heated reaction mixture before they have an opportunity to become coarser or agglomerate.

Higher rates of molten salt dilution are possible in the production of fine tantalum particles, as the siphon arrangement allows the fine particles to be efficiently extracted from the reaction bath after primary particle formation, and before adverse effects of heat and agglomeration can significantly occur and affect the particles.

Tantalum powders, or other valve metal powders, made by the processes, and capacitor anodes made with powders are also provided. In addition, systems for carrying out the above-indicated processes are also provided.

It is to be understood that both the foregoing general description and the following detailed description are exemplary and explanatory only and are intended to provide a further explanation of the present invention, as claimed.

As used herein, "siphon" refers to a tubular member having inlet and discharge ends that allows fluid to drain from a fluid reservoir through an intermediate point that is higher than the fluid reservoir with flow driven by a difference in hydrostatic pressure at the opposite ends of the tubular member. Depending on the siphon, a small pressure differential can cause flow through the siphon. A magnitude of pressure differential can make a difference in the flow rate through the siphon. The pressure differential can be about 0.1 to about 0.5 kPa or higher. The geometric cross-section shape of the tubular member is not limited, and can be any shape, such as circular, oval, square, and so forth.

BRIEF DESCRIPTION OF THE DRAWINGS

The accompanying drawings, which are incorporated in and constitute a part of this application, illustrates some of the embodiments of the present invention and together with the description, serves to explain the principles of the present invention.

EXPLANATION OF DRAWING SYMBOLS

Figure 1:
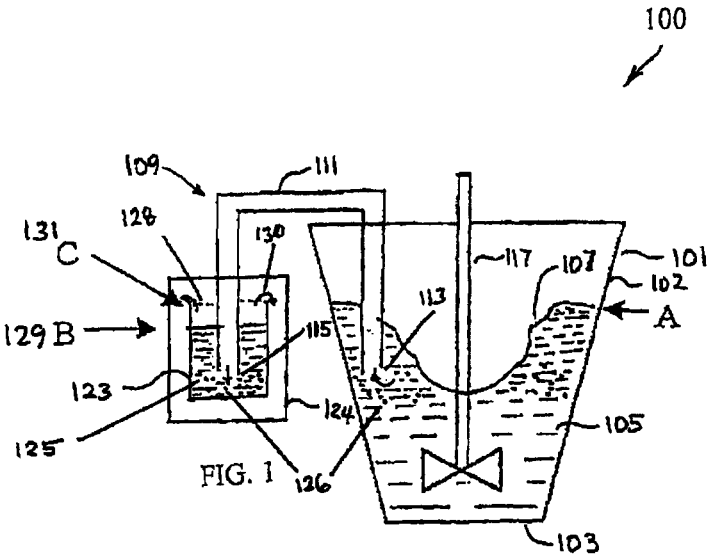
FIG. 1 is a cross sectional view illustrating a manufacturing device of tantalum powder used in an embodiment of the manufacturing methods of tantalum powder in the present invention.

| | |
|---|---|
| 100, 200 | Manufacturing device |
| 101, 201 | Reactor container |
| 102, 202 | Reactor side wall |
| 103, 203 | Reactor bottom |
| 105, 205 | Reaction mixture (bath) |
| 107, 207 | Reaction mixture surface level |
| 109, 209 | Siphon |
| 111, 211 | Siphon tubular member |
| 113, 213 | Siphon inlet end |
| 115, 215 | Siphon discharge end |
| 117, 217 | Reactor agitator |
| 123, 223 | Recovery vessel |
| 124, 224 | Recovery vessel outflow collector container |
| 125, 225 | Recovery vessel particle fluid |
| 126, 226 | Fine tantalum particles |
| 128, 228 | Recovery vessel upper open end |
| 129, 229 | Recovery vessel non-equilibrium fluid level |
| 130, 230 | Recovery vessel overflow particle fluid |
| 131, 231 | Recovery vessel equilibrium liquid level |
| 219 | Reaction material introduction pipe |
| 221 | Gas introduction pipe |
| 241 | Gas equilibrium pipe between reactor container and recovery vessel |

DETAILED DESCRIPTION OF THE PRESENT INVENTION

According to the present invention, a reduction process, such as a tantalum halide reduction process, is performed in a molten salt reaction vessel including an automatic siphon used to recover non-agglomerated fine metal particles, such as tantalum particles, produced by the reaction. The process uses a siphon for removal of individual tantalum particles from the reaction mixture that have grown or developed into primary particles of small size, and before they become undesirably coarse, agglomerated, or dendritic. Small sized primary particles of tantalum can yield high capacitive charge. Thus, they can be advantageously used as anodes for electrolytic capacitors and in other products. The small size primary particles of tantalum also have less opportunity to pick-up impurities before they are recovered with the siphon, as compared to agglomerates.

In processes of the present invention, fine metallic tantalum powder generally can be produced by the reduction of a tantalum precursor compound, such as a tantalum halide salt, by means of a reducing agent. The tantalum precursor compound can be any compound reducible to tantalum metal by reaction with reducing metal, and may be utilized in any physical state that is convenient or desirable. Such compounds typically can include, for example, potassium fluorotantalate ($K_2TaF_7$), sodium fluorotantalate ($Na_2TaF_7$), and/or tantalum chloride ($TaCl_5$), and any mixtures thereof. Regarding the reducing agent, any substance can be used which under the reaction conditions of the process according to the invention can bring about a reduction of a valve metal precursor to the elemental valve metal. Alkali metals or alkaline earth metals such as sodium, magnesium, calcium etc., or hydrides thereof, that is, magnesium hydride and calcium hydride, are mentioned as non-limiting examples of the reducing agent. Sodium is preferred. The physical properties of tantalum powders, such as the grain size or specific surface for example, are generally controlled at least in part by the addition of inert diluent salt to the reaction mixture. The term diluent salt generally refers to, for example, alkali halides including, but not limited to, salts such as potassium chloride, sodium chloride, potassium fluoride, sodium fluoride, eutectic salts, or any combinations thereof.

In the present invention, a siphon can be used to extract tantalum particles from the reaction mixture during the reduction reaction, after the reduction reaction, or both. The reaction mixture can be agitated or at rest (non-agitated) when fine tantalum particles, such as primary particles, are separated from the molten reaction mixture with a siphon. The molten reaction mixture is in the form of a flowable fluid material that is responsive to hydrostatic pressures within the process system. The inlet end of the siphon can be positioned at a depth within the reaction mixture where the tantalum particles develop to a primary particle of a desired size, such as a small primary particle size. The tantalum particles having small primary particle sizes can be transferred out of the reaction mixture from that location before they agglomerate or become coarser. The recovered tantalum particles collected in processes of the present invention can be predominantly primary particles. Further, the recovered tantalum particles can be primary particles predominantly having a particle size less than 2,000 nm, or about 1 nm and about 2,000 nm, or about 10 nm to 1,000 nm, or from about 10 nm to about 100 nm.

A reduction process can be provided for producing and recovering fine tantalum powder by a siphon from an agitated molten reaction mixture without the need to disrupt the reaction or agitation. A reducible tantalum halide, a reducing agent, and diluent salt are agitated, such as to reduce inter-particle contacts and agglomeration, and fine tantalum particles are automatically withdrawn during the agitation by siphon to a separate recovery vessel when the reaction mixture has a surface level in the reactor vessel that is higher than the surface level of recovered fluid in the recovery vessel. Outflow from the reactor vessel can automatically discontinue at those times when the reaction mixture fluid level becomes the same as the fluid level in the recovery vessel. The recovery vessel also can be provided with an open upper end to establish an overflow height that defines a fluid height for both the recovery vessel and reactor vessel at which hydrostatic pressure can equilibrate within the system and, as a result, reactor vessel outflow discontinues when fluid levels in both respective vessels are at that outflow level.

Referring to FIG. 1, a manufacturing device 100 is shown in which a reduction process is provided for producing and recovery of fine tantalum powder with a siphon. A molten reaction mixture 105 comprising a reducible tantalum halide, a reducing agent, and diluent salt is agitated using agitator 117 in a reactor vessel 101. The agitator 117 disperses the reaction batch components and metal particle products to reduce inter-particle contacts and agglomeration. Fine tantalum particles are automatically withdrawn from reaction mixture 105 by siphon 111 to a separate recovery vessel 123. The siphon 109 is a tubular member 111 having an inlet end 113 submerged in reaction mixture 105 and an opposite discharge end 115 in recovery vessel particle fluid 125. The tantalum halide reduction chemistry performed in the reactor vessel 101 is not particularly limited. It can be a conventional one. For example, it can comprise addition of molten sodium to a tantalum halide dissolved in diluent salts in the reactor vessel 101 to produce tantalum particulate product. The reaction can be carried out under constant agitation with agitator 117 sufficient to keep the reaction mixture 105, and, particularly, primary metal particles 126 well dispersed in the reaction bath. The inlet end 113 of siphon 109 is positioned at a depth where primary metal particles 126 just form. The siphon provides a fluid passage between the reactor vessel 101 and the recovery vessel 123 through which fine tantalum particles dispersed in small portions of molten fluid can be transferred and recovered. It will be appreciated that the size of the tantalum particles 126 indicated in FIG. 1 (and FIG. 2) are not to scale and are enlarged merely to facilitate the illustration.

The siphon 109 can be primed in any suitable manner. For example, the flow of a small amount of molten salt and fine tantalum particles can be initiated through siphon 109 in several manners. For example, the inlet end 113 can be submerged in reaction mixture 105 and a vacuum can be drawn at the opposite discharge end 115 using any convenient means, such as a vacuum pump, that is adequate to draw a portion of molten salt and fine tantalum particles 126 as particle fluid 125 through tubular member 111 of the siphon 109. Alternatively, an external gas, not shown in FIG. 1, can be introduced into a closed variation of reactor 101, which holds the reaction mixture 105, sufficient to create a positive hydrostatic pressure on the surface 107 of the reaction mixture effective to push molten salt fluid and particles held within vessel 101 into and through siphon 109 until exiting discharge end 115 into recovery vessel 123. This approach to priming a siphon connection between the reactor vessel and recovery vessel is described in greater detail infra in the discussions of FIG. 2, and reference is made thereto. As shown in FIG. 1, the siphon 109 allows fluid to drain from the reaction mixture bath 105 through an intermediate point of the siphon 109 that is higher than the surface level 107 of the reaction mixture 105 with flow driven by the difference in hydrostatic pressure. A minimal pressure differential that can cause fine tantalum particle fluid flow through the siphon 109 can be, for example, about 0.1 to about 0.5 kPa. The geometric cross-section shape of the tubular member 109 is not limited, and can be circular, oval, square, and so forth. Outflow from the reactor vessel 101 will automatically discontinue at those times when the fluid level 107 of reaction mixture 105 becomes the same as the fluid level 129 in the recovery vessel 123.

Agitation or other reaction conditions can cause the surface level of the reaction mixture 105 to exceed the surface level 129 of the recovered fluid and particles 125 in recovery vessel 123. When the reaction mixture 105 has a surface level 107 (A) in the reactor vessel 101 that is higher in elevation than the surface level 129 of recovered fluid and particles 125 in the recovery vessel 123, outflow of fluid and particles from the reactor vessel 101 through siphon 109 into recovery vessel 123 will continue until the fluid and particle level rises to level 131 in recovery vessel 123, which corresponds to the upper open end 128 of the recovery vessel 123. At that point, a portion of the recovered fluid 130 will overflow from recovery vessel 123 into collector container 124, and it will continue to overflow as any additional fluid is transferred into the recovery vessel 123 via the siphon 109. The fluid level 107 of the reactor vessel 101 then falls until it is the same elevation as the upper open end 128 of the recovery vessel 123. At that point, hydrostatic pressure within the system 100 (i.e., in reactor vessel 101 and recovery vessel 123) can equilibrate, and outflow of fine particles and fluid from the reactor vessel 101 via the siphon 109 automatically discontinues. The outflow from reactor vessel 101 stops unless and until the fluid surface level 107 again exceeds that in the recovery vessel 123. Then, the above-indicated automatic siphon process can repeat itself without need of operator intervention. This process arrangement also allows for fine tantalum particles 126 having a desired size, such as primary particles, to be conveniently extracted near the vessel sidewall 102 in portions of the reaction mixture where they can be more concentrated and located away from the agitator 117 while it continues to stir and agitate the reaction mixture 105.

As indicated, agitation of the reaction mixture 105, also occasionally referred to herein as a reaction bath, can be maintained with agitator 117 during the reduction reaction and siphon removal of fine tantalum particles conducted during and/or after the reaction. The agitator can have blades with an outside diameter typically about ⅓ to about ⅔ that of the inside diameter of the reactor vessel 101. The agitator blades can be paddles or pitched blades, such as from about 30 to about 60 degrees pitch. Agitation with stirrer 117 is preferably provided continuously from the time the salt bath is molten until completion of the reduction reaction. In preferred embodiments, the agitator speed is typically varied in the range from about 50 to about 150 rpm during the run or from about 0.05 to 0.5 rpm per kg of the molten salt mixture when the mixture is in the range of 500 to 1000 kg, or from 1 to 10 m/second velocity in circumference. Faster agitator speeds can be used during the nucleation period when the highest sodium feed rate is used, and slower speeds can be used during slower sodium feed rates and after completion of sodium feed.

The reactor vessel 101 utilized in the method of the present invention can be the reactors generally used by those of ordinary skill in the art for the production of tantalum powder via the reduction of a tantalum compound. Generally, a typical reactor assembly includes a reactor, a fitted lid, an agitator, a thermowell, gas inlet and outlet ports, and ports for loading (charging the reactor) and removing materials. Several of these features are shown in more detail in FIG. 2. In a preferred embodiment, the reactor vessel, the recovery vessel, and the siphon tubular member are adapted to be heated to heat reaction materials, products or other materials contained therein. The reactor vessel can be heated by conventional vessel heating means (not shown), such as, and for example, a heating jacket surrounding the vessel, heating coils, heating plates, or an electrical resistance or induction heater. The recovery vessel can be heated by vessel heating means similar or different from that used with the reaction vessel. The siphon tubular member can be heated by heating means (not shown) suitable for heating tubes, such as electric resistance elements or induction heaters. The reactor vessel, recovery vessel, and the agitator can be made of tantalum, pure nickel, nickel based alloys, or iron based alloys, or other metals that can tolerate the reaction temperatures, reactants, and other conditions. The collector container 124 can be, for example, an Inconel-made supporting container.

Figure 2:
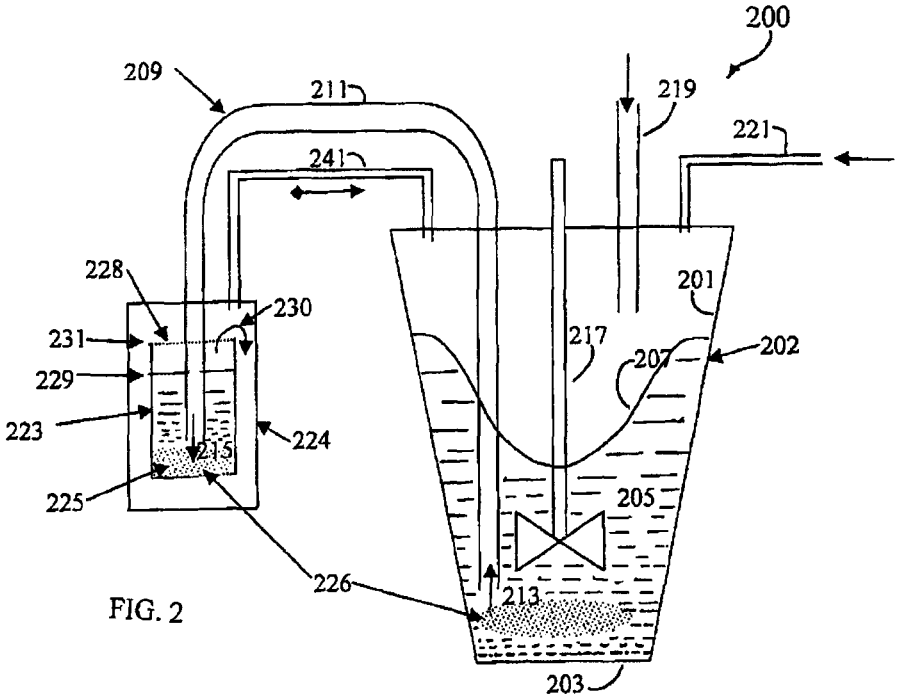
FIG. 2 is a cross sectional view illustrating a manufacturing device of tantalum powder used in a further embodiment of the manufacturing methods of tantalum powder in the present invention.

Referring to FIG. 2, the manufacturing device 200 is shown including a siphon configuration having similarities to that of FIG. 1 with respect to the reduction process and equipment. The reactor vessel 201 is a closed vessel. Additional details on the use of external gas to prime the siphon are illustrated in this embodiment. An external gas can be introduced through pipe 221 into a closed reactor vessel 201, while the discharge end 215 of siphon 209 is equilibrated by gas equilibrium pipe 241, sufficient to create a positive hydrostatic pressure on the surface 207 of the reaction mixture 205 to push some molten salt and fine tantalum particles 226 held within reactor vessel 201 as particle fluid 225 into and through siphon 209 until exiting discharge end 215 into recovery vessel 223. A minimal pressure differential that can cause fine tantalum particle fluid flow through the siphon 209 can be, for example, about 0.1 to about 0.5 kPa. Pipe 219, and/or other similar introduction pipes not shown, can be used for introduction of reactants and/or diluents into the reactor vessel 201. In other respects, the reaction and siphon system of device 200 can be operated similarly to above-described device 100, and reference is made thereto.

In an illustrative manufacturing process of the tantalum powder, the process for operating the manufacturing device 100 or 200 can include the following steps. In order to prevent impurities from being mixed in, the vessel 101 (201) is optionally washed with water in advance and preferably is fully dried after further subjecting it to optional ultrasonic cleaning. Next, diluent salt is added into the vessel 101 (201). The inside of the vessel 101 (201) is heated to regulate molten salt, and while stirring the inside of the vessel 101 (201) by the stirring means 117 (217), potassium tantalum fluoride ($K_2TaF_7$) is added to be dissolved into the molten salt. The siphon 109 (209) is installed and primed, such as in manners indicated above. Next, while continuing to stir, a reducing agent(s) can be added, such as incrementally added, into the potassium tantalum fluoride dissolved in the molten salt. As a result, the potassium tantalum fluoride is reduced and fine tantalum particles composed of primary particles are formed. The reducing agent can be dispersedly added, which means simultaneously adding (or substantially simultaneously) at a plurality of spots or locations. When sodium is used as a reducing agent, fluorine in potassium tantalum fluoride and sodium react to each other, generating a fluoride of sodium. The fluoride is water soluble and therefore easily removed in the latter process. 770° C. to 880° C. is a preferred internal temperature of the vessel 101 (201). If the internal temperature of the vessel 101 (201) is 770° C. or above, then the components in the vessel 101 may be dissolved with certainty, and if it is 880° C. or below, self-sintering of the generated tantalum primary powder may be prevented, thus preventing the generated particles from becoming coarse. Other temperatures can be used, such as less than 770° C. or higher than 880° C., and can depend on the reduction chemistry and feed rate conditions applied. For instance, NaF has a melting point of 993° C., and NaCl:KCl:LiCl=10:55:35 has a melting point of 346° C.

The reduction reaction produces tantalum powder and metal salts. The siphon inlet end 113 (213) preferably is positioned within the reaction mixture 105 (205) at a location where primary particles of tantalum are just formed with the desired or selected small size for extraction. For example, the inlet end of the siphon can be positioned within the reaction mixture wherein at least 75 weight %, or at least about 90 weight %, of the transferred tantalum particles are primary particles. The location of the siphon inlet end can be repositioned during the reaction. The recovery vessel and the siphon tubular member are heated, such as to 500 to 800° C., or 700 to 770° C., during the reducing reaction.

With respect to the processes of the present invention, as well as the system for producing and recovering metal particles, such as tantalum particles, the process and/or system can be operated in a fully (e.g., continuous operation), semi-continuous, or non-continuous (e.g., batch) manner. Any of these types of operations are possible. In a batch system or process, the amounts will be generally pre-determined and added prior to the operation of the process. In a semi-continuous operation, the various ingredients and process steps can occur at various intervals in order to ensure that there is a sufficient amount of reactants and diluents present and that the removal of tantalum fines is periodically accomplished. In a continuous fashion, the amount of reactants and diluents can be incremental or continuous and can be at a rate to coincide with the rate of removal of fines to achieve the continuous reaction. In another illustrative manufacturing process of the tantalum powder, fine tantalum particle recovery can be conducted as a continuous process. The reactants, i.e., the tantalum compound and the reducing agent, and the diluents can be added continuously to the reactor vessel 101 (201) at a rate that is correlated with the rate of removal of tantalum fine particles produced by the reaction. Depending on the theory of the siphon, outflow of the tantalum fine powder is linked with the addition of reaction materials to the reactor vessel 101 (201). When reactants and diluents are added continuously to the reactor vessel 101 (201), a continuous outflow of tantalum fine particles from the reactor vessel 101 (201) into the siphon 109 (209) and on to the recovery vessel 123 (223) can be achieved. The flow of tantalum fine particles into siphon 109 (209) can be controlled by adjusting the reaction mixture surface level 107 (207).

After the reducing reaction has been run to completion, the particle fluid 125 (225), which is a reaction mass of tantalum powder and metal salts, which has been collected via the siphon 109 (209) in the recovery vessel 123 (223) can be processed by leaching with water to dissolve the salts followed by acid wash prior to recovery of the tantalum powder. The contents of the vessel reactor 101 (201) and recovery vessel 123 (223) can be respectively drained from the containers for further processing, re-use or disposal, as applicable, by installing and using a heat-resistant valve near the bottom of the containers (not shown), or by other suitable fluid drain means. The tantalum powder collected in the recovery vessel then can be dried, screened, doped, and heat treated by methods known to those skilled in the art. The powder can also be blended with other tantalum powders and then screened, doped, and heat treated.

Among other advantages, the processes illustrated in FIGS. 1 and 2 have an advantage of making it possible to remove a tantalum particle of desired size at an arbitrary selected depth within the reaction mixture using the siphon system, essentially without needing to disturb the reaction system from molten salt and while keeping the reaction mixture under agitation and well-dispersed.

In addition to the above-indicated benefits, the processes of the present invention also can provide many other advantages and benefits. Fine tantalum particles can be separated and isolated from the heated reaction mixture before they have an opportunity to become coarser or agglomerate. Higher rates of molten salt dilution are possible in the production of fine tantalum particles, as the siphon arrangement, for example, allows the fine particles to be efficiently extracted from the reaction bath after primary particle formation, and before adverse effects of heat and agglomeration can significantly occur and impact the particles. The heated diluent salts remaining in the reactor vessel after the reaction can be reused in an energy efficient and material conserving manner in one or more successive production runs conducted in the same or different reactor. Another advantage of the processes of the present invention is that they provide methods for producing and recovering fine tantalum particles or other valve metal particles in a molten salt reaction mixture at an economical high rate of molten salt dilution.

The present invention also permits installation of the inlet of the siphon in different selectable positions of a reaction vessel. It can be installed in a position where the particle has grown to a primary particle of the size desired or needed. That is, when the particle for the purpose of recovery collects on the bottom of a molten salt reduction vessel, there is no necessity that a pipe must be extended straight into the areas of the vessel and contents thereof where agitation may need to be mechanically imparted, and instead all that is necessary is just to lengthen a siphon pipe inlet to a bottom of the vessel. Moreover, by adjusting a siphon pipe entrance, extraction and recovery of fine metal particles can be provided where they are piling up in a zone at a specific height of the molten salt reduction vessel. Recovery can start automatically from the time sodium supply is commenced into the reactor vessel requiring the siphon movement at the tantalum salt injection and dissolution times, as the siphon pipe width can adjust the outflow speed of molten salt for efficient small particle collection.

The tantalum powder produced can be used to form a capacitor anode (e.g., wet anode or solid anode). The capacitor anode and capacitor (wet electrolytic capacitor, solid state capacitor, etc.) can be formed by any method and/or have one or more of the components/designs, for example, as described in U.S. Pat. Nos. 6,870,727; 6,813,140; 6,699,757; 7,190,571; 7,172,985; 6,804,109; 6,788,523; 6,527,937 B2; 6,462,934 B2; 6,420,043 B1; 6,375,704 B1; 6,338,816 B1; 6,322,912 B1; 6,616,623; 6,051,044; 5,580,367; 5,448,447; 5,412,533; 5,306,462; 5,245,514; 5,217,526; 5,211,741; 4,805,704; and 4,940,490, all of which are incorporated herein in their entireties by reference. The powder can be formed into a green body and sintered to form a sintered compact body, and the sintered compact body can be anodized using conventional techniques. It is believed that capacitor anodes made from the tantalum powder produced according to the present invention have improved electrical leakage characteristics. The capacitance of the tantalum powder can be, for example, from about 200,000 to about 800,000 μFV/g, or about 250,000 to about 600,000 μFV/g, when pressed into pellets, sintered at 1050° C., and anodized to 6V. With respect to leakage, the leakage can be 7 nA/CV or less, or 3 nA/CV or less.

Capacitors of the present invention also can be used in a variety of end uses such as automotive electronics; cellular phones; computers, such as monitors, mother boards, and the like; consumer electronics including TVs and CRTs; printers/copiers; power supplies; modems; computer notebooks; and disk drives.

While the above-described embodiments have been discussed using tantalum as the preferred material, the present invention equally applies to other valve metal materials, such as niobium, and other valve metal materials, such as any metals from groups IVb, Vb and VIb of the periodic table, or titanium, zirconium, hafnium, vanadium, chromium, molybdenum, tungsten, and alloys thereof.

The present invention will be further clarified by the following theoretical example, which is intended to be exemplary of the present invention. In this non-limiting illustration, a method of the present invention is carried out in a manufacturing device as shown in FIG. 1. 15 kg of potassium fluoride and 15 kg potassium chloride is charged to a reactor vessel and the temperature and raised to 800° C. to melt the salts under agitation. 37.5 g $K_2TaF_7$ is introduced with agitation for one minute and dissolved in the diluent salts, 10.8 g sodium is added and the temperature is brought back to 800° C. incrementally 40 times at 5 minute intervals. Concurrent with sodium addition, 45 g molten salt with tantalum powder is siphoned from the reaction mixture at a location near the vessel bottom 40 times at one minute intervals. The salt fluid and tantalum powder is removed from the recovery vessel and processed in a conventional manner by leaching with appropriate solvents to dissolve the salts and recover the tantalum powder. The tantalum powder product is dried at 120° C. by steam dryer.

Applicant specifically incorporates the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. Process for producing and recovery of tantalum particles, comprising:

forming tantalum particles by adding at least one reducing agent into a reaction mixture comprising a reducible tantalum halide and molten diluent salt in a reactor vessel to form fine tantalum particles;

transferring fine tantalum particles from said reaction mixture to outside the reactor vessel through a siphon comprising a tubular member having an inlet end positioned within the mixture for fine particle extraction from the reaction mixture and a discharge end located outside the vessel for fine particle recovery; and further comprising positioning the inlet end of said siphon at a location within the reaction mixture where the transferred tantalum particles predominantly have a particle size less than about 2,000 nm, wherein the reaction mixture is at rest during said transferring of said fine tantalum particles.

2. The process of claim 1, further comprising positioning the inlet end of said siphon at a depth within the reaction mixture where the transferred tantalum particles are predominantly primary particles.

3. Process for producing and recovery of tantalum particles, comprising:

forming tantalum particles by adding at least one reducing agent into a reaction mixture comprising a reducible tantalum halide and molten diluent salt in a reactor vessel while agitating the reaction mixture to form fine tantalum particles;

transferring fine tantalum particles from said reaction mixture to a recovery vessel separate from the reactor vessel through a siphon comprising a tubular member having an inlet end positioned within the reaction mixture and a discharge end located outside the vessel, wherein said transferring of said fine tantalum particles comprising outflowing of fluid containing fine tantalum particles from the reactor vessel to a separate recovery vessel via the siphon when the fluid level of the reaction mixture in the reactor vessel is higher than the fluid level in the recovery vessel and said outflowing discontinuing when the liquid level equals that of the recovery vessel; and further comprising positioning the inlet end of said siphon at a location within the reaction mixture where the transferred tantalum particles predominantly have a particle size less than about 2,000 nm; and further comprising positioning the recovery vessel within an overflow collector container, wherein outflow of said fluid from the reactor vessel to the recovery vessel when the fluid surface level in the reactor vessel exceeds the fluid level in the recovery vessel continues until fluid level of the recovery vessel reaches an upper open end thereof and overflows into the collector container and the fluid level in the reactor vessel falls to the level of said upper open end of the recovery vessel.

4. The process of claim 3, further comprising positioning the inlet end of said siphon at a location within the reaction mixture where the transferred tantalum particles predominantly are primary particles.

5. The process of claim 3, further comprising positioning the inlet end of said siphon at a location within the reaction mixture where at least 75 weight % of the transferred tantalum particles are primary particles.

6. The process of claim 3, further comprising positioning the inlet end of said siphon at a location within the reaction mixture where the transferred tantalum particles predominantly have a particle size from about 1 nm to about 2,000 nm.

7. The process of claim 3, wherein said adding of a reducible tantalum halide comprises adding potassium fluorotantalate.

8. The process of claim 3, wherein said forming comprising dissolving $K_2TaF_7$ in molten alkali halide diluent salt, and adding sodium to reduce $K_2TaF_7$ to Ta particles.

9. The process of claim 3, wherein the diluent salt is potassium chloride, potassium fluoride, sodium chloride, sodium fluoride, or combinations thereof.

10. The process of claim 3, further comprising maintaining the reaction mixture at a temperature of about 770° C. to about 880° C.

11. The process of claim 3, further comprising washing and heat treating said transferred fine particles to form a tantalum powder.

* * * * *